United States Patent [19]

Pugh et al.

[11] 4,209,875

[45] Jul. 1, 1980

[54] CORDLESS VACUUM CLEANER BOWL AND FILTER SYSTEM

[75] Inventors: Timothy G. Pugh, Baltimore; Omer L. Shifflett, Jr., Lutherville, both of Md.

[73] Assignee: Black & Decker, Inc., Newark, Del.

[21] Appl. No.: 932,762

[22] Filed: Aug. 11, 1978

[51] Int. Cl.[3] ..... A47L 5/24

[52] U.S. Cl. ..... 15/344; 15/347

[58] Field of Search ..... 15/344, 347, 350, 351

[56] References Cited

U.S. PATENT DOCUMENTS

| | | | |
|---|---|---|---|
| 4,011,624 | 3/1977 | Proett | 15/344 |

FOREIGN PATENT DOCUMENTS

| | | | |
|---|---|---|---|
| 1147360 | 4/1963 | Fed. Rep. of Germany | 15/344 |
| 1453075 | 2/1969 | Fed. Rep. of Germany | 15/350 |
| 2046130 | 3/1972 | Fed. Rep. of Germany | 15/344 |
| 394527 | 11/1965 | Switzerland | 15/344 |
| 877883 | 9/1961 | United Kingdom | 15/344 |
| 990065 | 4/1965 | United Kingdom | 15/344 |

*Primary Examiner*—Christopher K. Moore

*Attorney, Agent, or Firm*—Finnegan, Henderson, Farabow, Garrett & Dunner

[57] ABSTRACT

A hand-held cordless electric vacuum cleaner including separable power and bowl units secured by a releasable latch. The power unit includes a housing formed with a handle and enclosing an electric motor and fan, batteries for the motor, and a switch for turning the motor on and off. The bowl unit includes a hollow bowl provided with an air inlet opening and an integral internal nozzle communicated with the fan when joined to the power unit. A filter assembly including a ring and a filter bag is positioned wholly within the bowl between the air inlet opening and fan and is removable from the bowl after the units are separated, whereby dirt and debris contained in the bowl are not spilled during separation of the units. A flapper covers the nozzle when the unit is off to prevent dirt in the bowl from coming out of the opening.

4 Claims, 12 Drawing Figures

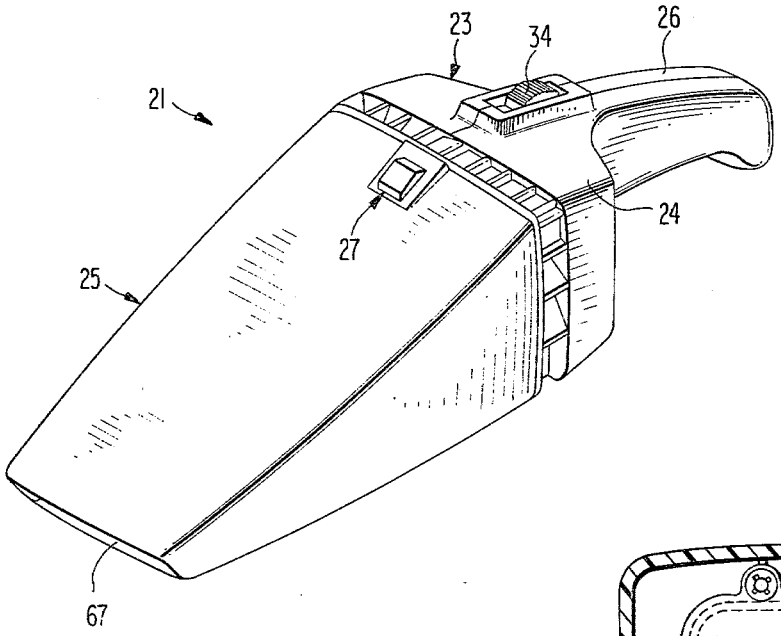
FIG 1
FIG 4
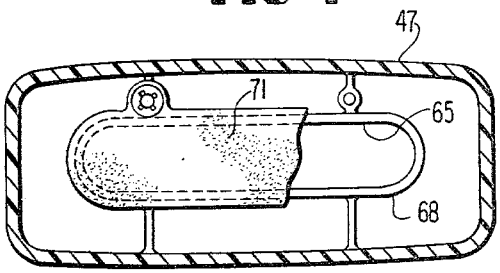
FIG 5
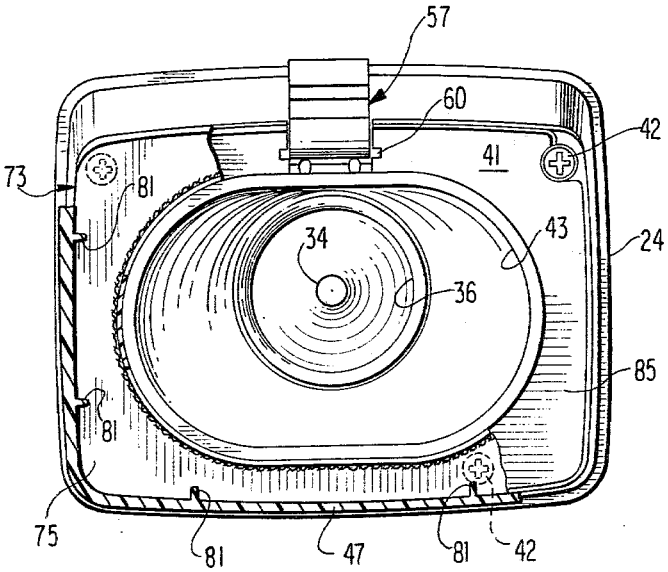
FIG 6
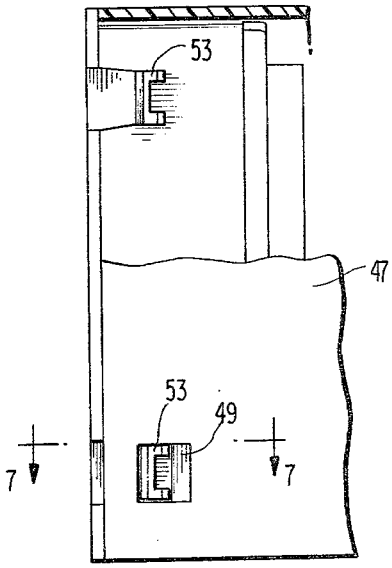
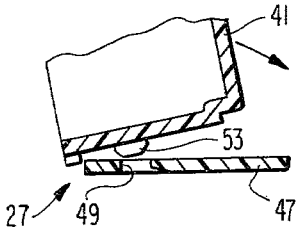
FIG 7

67
68
65
4.
4
71
80
47
25
77
79
73
5.
75
6.
57
63
56
87
41
85
62
61
60
43
64
58
31
36
32
8.
45
12.
34
23
37
29
24
39
26
33
35

67
65
68
71
80
47
25
81
83
63
77
79
73
75
82
87
9.
43
59
27
85
62
58
41
61
64
53
24
39
26

FIG 8
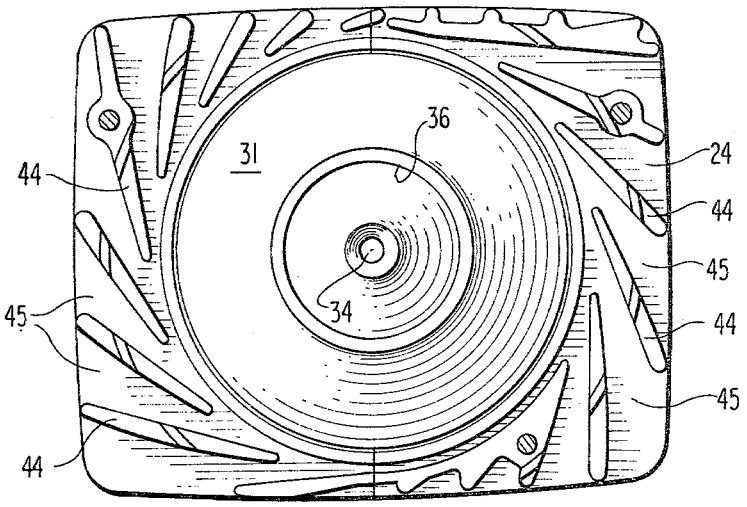
FIG 9
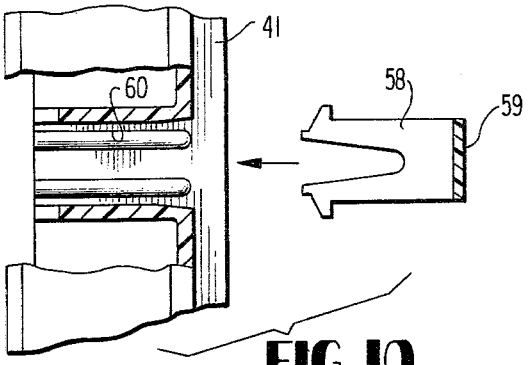
FIG 10
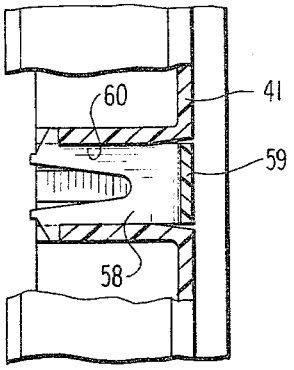
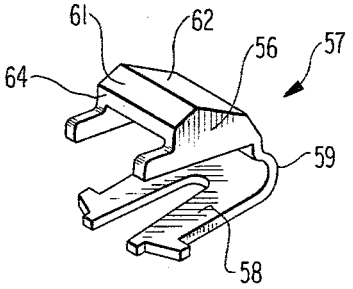
FIG 11
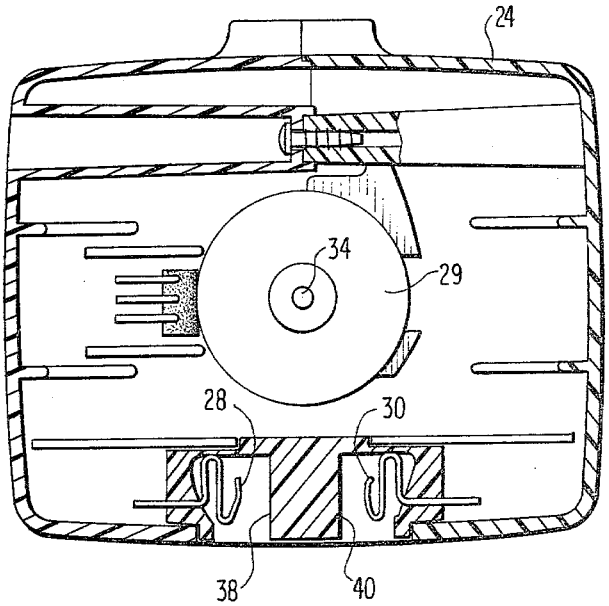
FIG 12

CORDLESS VACUUM CLEANER BOWL AND FILTER SYSTEM

BACKGROUND OF THE INVENTION

The present invention relates to electric powered vacuum cleaners, and more particularly, to a hand-held, electric vacuum cleaner which is constructed for convenient and easy emptying of dirt and avoids spilling, which is lightweight and balanced for easy handling, and which is simple in design and includes a minimum of separate parts.

Vacuum cleaners include a variety of types ranging from heavy duty shop-type vacuum cleaners used in basements, work rooms, garages, etc., and cannisters and uprights used for medium to heavy-duty cleaning of floors and floor coverings, furniture, and draperies, to the so-called stick-type vacuum cleaners which are used for light-duty dirt pick-up such as kitchen floors, and some light carpet cleaning.

In addition, even smaller and lighter weight vacuum cleaners, some of which are battery operated, have also entered the market in recent years. These vacuum cleaners are often used in the kitchen, for example, for picking up dirt and crumbs on kitchen counters and tables and on kitchen floors, and are also used on stairs, shelves, workshops, or any hard-to-get-to areas.

Many of these smaller units suffer from being clumsy and difficult to handle as a result of poor weight distribution. An even more important problem with these vacuum cleaners is that the dirt collection means is difficult to empty, and often results in spillage when the unit is opened in attempting to empty the dirt. Also, these units often are poorly designed with many separate parts, have inefficient air flow and dirt pick-up characteristics, and have an objectionably small dirt collection capacity which requires frequent emptying.

Thus, even though a definite need exists for a small, handheld, light-duty vacuum cleaner of this type, the many problems attendant with existing units tends to discourage their use.

SUMMARY OF THE INVENTION

The present invention overcomes the problems described above and satisfies the requisites for a small, hand-held vacuum cleaner by providing two separable units, one being a power unit, and the other a bowl unit into which dirt is drawn and retained. The bowl unit includes a hollow bowl and filter bag assembly removably positioned wholly within the bowl which confines the dirt and debris therein. The bowl is preferably a one-piece molded part and includes an internal nozzle formed integral therewith and terminating in an air inlet opening. The end of the bowl remote from the air inlet opening is constructed for ready attachment to and detachment from the power unit. When the bowl is detached from the power unit, the filter bag assembly remains within the bowl and prevents dirt spillage. The filter bag assembly is then easily removed from the bowl and the dirt can then be dumped.

In addition to the above and in accordance with the invention, the attached bowl and power units provide an exceptionally convenient, lightweight, and well-balanced vacuum cleaner. The power unit includes a housing formed with a handle and enclosing an electric motor and fan. The power unit can include rechargeable battery means which, together with the motor and fan and all the other weighted parts, are disposed with respect to the handle for optimum weight distribution. A switch for controlling on and off operation of the motor is conveniently actuated by means on or adjacent the handle. The power unit also includes a venturi means which, when the power unit is attached to the bowl, extends into the bowl and positions the filter bag assembly therein.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purposes of the invention, as embodied and broadly described herein, there is provided a hand-held electric vacuum cleaner comprising first and second separable units interconnected by releasable latch means, the first unit including a housing enclosing a motor and fan and having switch means for operating the motor, venturi means carried by the housing and extending forwardly of the fan, the venturi means having an opening therethrough communicated with and narrowing toward the fan and operable to increase the velocity of inlet air entering the fan, the second unit including a hollow bowl having an open end receiving the venturi means, a ring removably fitted in the bowl and carrying a filter bag, means limiting the inward movement of the ring relative to the bowl, the venturi means engaging the ring and holding it it place within the bowl, the releasable latch means including cooperable means on the venturi means and bowl and manually releasable to permit separation of the first and second units, the ring and filter bag being removable from the bowl upon separation of the first and second units.

The accompanying drawings which are incorporated in and constitute a part of this specification, illustrate one embodiment of the invention and, together with the description, serve to explain the principles of the invention.

BRIEF DESCRIPTION OF THE DRAWINGS

FIG. 1 is a perspective view of a hand-held, electric vacuum cleaner which embodies and is constructed in accordance with the present invention;

FIG. 4 is a sectional view of FIG. 2 taken along the line 4—4 thereof;

FIG. 5 is a sectional view of FIG. 2 taken along the line 5—5 thereof and with parts broken away for clarity;

FIG. 6 is a bottom plan view of a portion of FIG. 2 taken along the line 6—6 thereof;

FIG. 7 is a sectional view of FIG. 6 taken along the line 7—7 thereof and showing one position of parts during assembly and disassembly of the units;

FIG. 8 is an enlarged sectional view of FIG. 2 taken along the line 8—8 thereof;

FIG. 9 is a sectional view of FIG. 3 taken along the line 9—9 thereof;

FIG. 10 is a view similar to FIG. 9 and showing the parts prior to assembly;

FIG. 11 is a perspective view of a part of FIG. 10; and

FIG. 12 is an enlarged sectional view of FIG. 2 taken along the line 12—12 thereof.

DESCRIPTION OF THE PREFERRED EMBODIMENT

Figure 2:
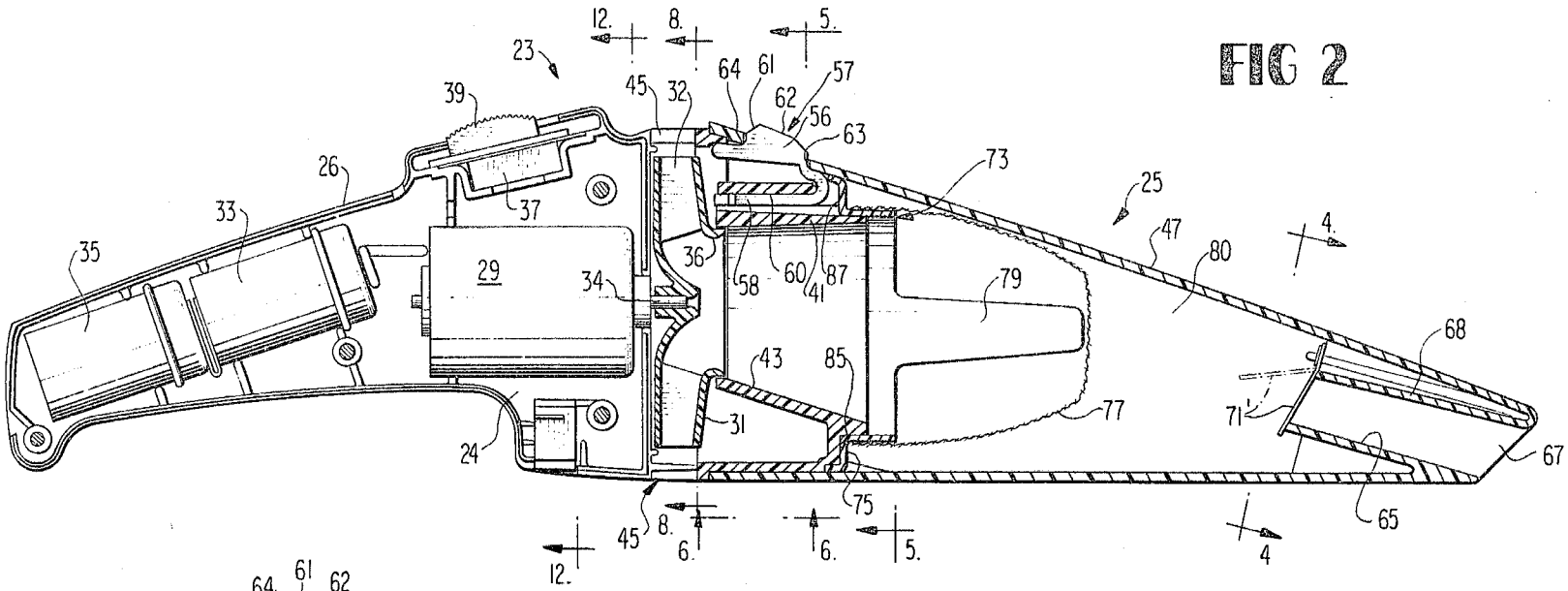
FIG. 2 is an enlarged sectional view of the vacuum cleaner shown in FIG. 1 taken along a line extending substantially longitudinally thereof.

Reference will now be made in detail to the present preferred embodiment of the invention, an examle of which is illustrated in the accompanying drawings.

The preferred embodiment, shown in FIG. 1, is seen to include a hand-held, electric vacuum cleaner 21 comprising first and second separable units 23, 25 interconnected by a releasable latch means 27. As embodied herein, the first unit 23 is a power unit which includes a clam shell housing 24 formed with a handle 26 and enclosing an electric motor 29 and a fan 31 (see FIG. 2). Battery means including a plurality of rechargeable batteries 33, 35 are positioned within the handle 26 and are electrically connected to the motor 29. A pair of electrical terminals 28 and 30 (FIG. 12) are positioned within the housing 24 and are connected to the batteries 33, 35. The terminals 28 and 30 are accessible from outside the housing 24 through openings 38 and 40 for connection to a plug (not shown) for recharging the batteries 33, 35. Switch means for turning the motor 29 on and off includes a switch 37 within the housing 24 and a slidable switch operator 39 located outside the housing 24 on or adjacent the handle 26.

The fan 31 is of the centrifugal type which includes blades 32, and is fixed to a motor shaft 34. When the motor 29 is energized, the fan 31 rotates and causes air to be drawn axially through an inlet opening 36 and discharges it radially outwardly between blades 32.

Venturi means is provided and includes a venturi 41 fixed to the housing 24 forwardly of the fan 31 by screws 42 (FIG. 5). The venturi 41 includes a passageway 43 which converges toward and is communicated with the inlet opening 36 of fan 31. The housing 24 includes diffuser means formed by equidistant radially spaced louvers 44 which define air discharge openings 45 adjacent the outer periphery of the fan 31 (see FIG. 8). Thus, when the motor 29 is turned on, the rotating fan 31 causes air to be drawn through the venturi passageway 43 into the fan inlet opening 36. The air then moves outwardly between the fan blades 32 and is discharged through openings 45.

In accordance with the invention, the second unit 25 of the vacuum cleaner 21 is detachably connected to first or power unit 23. As embodied herein, the second unit 25 is a bowl unit and includes a bowl 47 constructed as a hollow, one-piece, molded member having an open end connected to the first or power unit 23. The bowl 47 is constructed of a suitable tough, impact resistant material such as polypropylene.

In accordance with the invention, and as described above, the power unit 23 and bowl unit 25 are connected by a releasable latch means 27. As embodied herein, the latch means includes one or more openings 49 formed in the bottom of bowl 47 to receive corresponding projections 53 formed on the bottom of venturi 41 (see FIG. 6). The releasable latch means 27 also includes a flexible latch member 57 (FIG. 11) carried by the venturi 41 and engageable in an opening 63 in bowl 47. The member 57 is formed with a pair of arms 56, 58 connected by a flexible web 59 so that arms 56, 58 can move toward and away from one another. Arm 58 is bifurcated and is fixed to the venturi 41 by snapping into place in an opening 60 (see FIGS. 9 and 10). Arm 56 includes a button 61 shaped with a camming surface 62 and a locking shoulder 64. Latch member 57 can be constructed of, for example, acetal.

To assemble the power and bowl units 23, 25, they are positioned as shown in FIG. 7 with the bowl 47 and venturi 41 tilted slightly and the venturi 41 extending partly into the bowl 47 with projections 53 aligned with openings 49. The projections 53 are then inserted in openings 49 and the units 23, 25 are rocked in the direction of the arrow toward the aligned and assembled position shown in FIG. 2. During this movement, the camming surface 62 on latch button 61 engages the edge of bowl 47. The flexible web 59 allows the arm 56 of latch member 57 to move toward arm 56 until finally, the locking shoulder 64 snaps into position in the opening 63 in bowl 47.

Figure 3:
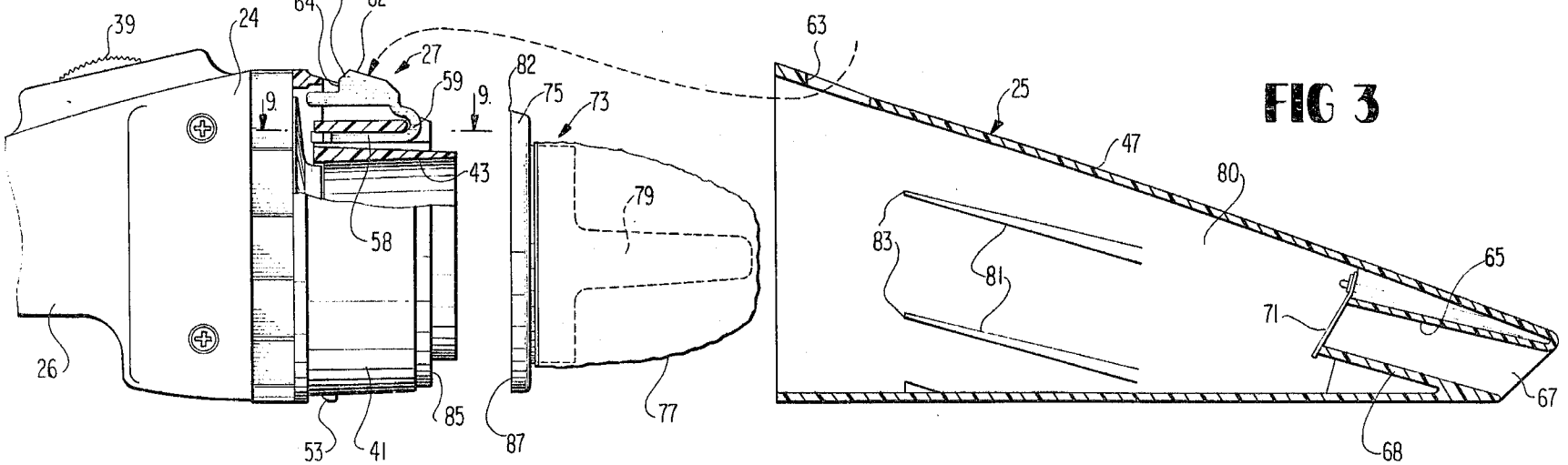
FIG. 3 is an exploded view of FIG. 2 and showing the parts separated for emptying dirt.

Conversely, when the power and bowl units 23, 25 are to be separated, such as when the dirt is to be emptied from the bowl 47, as will be described, the latch button 61 is depressed far enough to release the shoulder 64 from bowl opening 63. The units 23,25 are then tilted toward the position shown in FIG. 7 (opposite the direction illustrated by the arrow) and are separated. Full separation of units 23, 25 is illustrated in FIG. 3.

As embodied herein, the bowl 47 is a one-piece member which can be molded of a tough, impact resistant material such as polypropylene. A nozzle 65 extends inwardly from an air inlet opening 67. The nozzle 65 is formed by a continuous skirt 68 which is molded integrally with the bowl 47 and is wholly within and spaced from the bowl itself except where it is joined to the bowl 47 adjacent the opening 67. The nozzle 65 is straight and substantially aligned with venturi passage 43, and has a generally constant cross sectional area throughout its length for maximum air flow and efficiency in picking up dirt.

By molding the nozzle 65 as one piece with the bowl 47, the need for an extra part, i.e. a separate nozzle, is eliminated. Further, by constructing the nozzle skirt 68 wholly internally of the bowl 47 and spaced therefrom except where joined adjacent the opening 67, the size and shape of the nozzle has no effect on the external contour of the bowl 47. This allows for maximum design latitude in the bowl 47 and results in the aesthetically pleasing appearance shown in FIG. 1.

A resilient flapper 71 is securely fastened in place over the internal end of the nozzle skirt 68. The flapper 71 is normally positioned as shown in full lines in FIG. 2 so that it closes the nozzle 65 and inlet opening 67. However, when the motor 29 is turned on, air drawn by the fan 31 through the venturi 41 exerts suction on the flapper 71 and causes it to lift away from the nozzle 65 as shown by dot-dash lines in FIG. 2. This causes air flow through nozzle 65 and dirt to be drawn through inlet opening 67. When the motor 29 is again turned off, the flapper 71 returns to the full line closed position and dirt trapped within the bowl 47 cannot escape through the inlet opening 67.

In accordance with the invention, the bowl unit 25 includes a filter bag assembly 73 positioned wholly within the bowl 47 and which is removable therefrom only after separation of the bowl 47 from the power unit 23. As embodied herein, the filter bag assembly 73 includes a ring 75 and an integral framework formed by a plurality of ribs 79. As air permeable filter bag 77 is fitted over ribs 79 and is fixed to ring 75. The framework ribs 79 hold the bag 77 extended as shown in FIG.

2 and insure that a maximum area of the filter bag 77 is exposed to air flow through the vacuum cleaner.

The ring 75 can be formed of a suitable plastic material, such as polyethylene, polypropylene, or PVC. The bag 77 can be formed of a porous non-woven polyester material having pores which are sufficiently small to resist passage of dirt. The bag 77 and ring 75 are preferably permanently attached such as, for example, by stitching, hot welding, or by using a suitable adhesive material.

In accordance with the invention, means is provided to limit inward movement of the filter bag assembly relative to the bowl 47. As here embodied, the outer periphery of the ring 75 is shaped generally complementary to the internal surface of the bowl 47. Desirably, the upper surface of the bowl 47 and ring 75 are tapered so that when the filter bag assembly 73 is inserted into the bowl 47, the ring 75 wedges into engagement with the wall of the bowl 47. In addition, the ring 75 has a thin feathered edge 82 of plastic material which, under the force of engagement with the bowl 47, takes a permanent or semi-permanent set conforming to the shape of the bowl 47, sometimes referred to as "cold flow", and sealingly engages the bowl 47. When so positioned, the filter bag assembly 73 and bowl 47 define a dirt-collecting chamber 80. If desired, the bowl 47 can be formed with ribs 81, which define shoulders 83 to prevent the ring 75 from moving too far into the bowl 47. Desirably, the ring 75 wedges into engagement with the bowl 47 before engaging the shoulders 83. This insures that the ring 75 sealingly engages the bowl 47 and prevents dirt from passing the ring.

In accordance with the invention, the bowl 47 and filter ring assembly 73 are constructed so that the assembly 73 remains within the bowl 47 when the units 23, 25 are detached and separated. As here embodied, the wedging engagement between ring 75 and bowl 47 prevents the assembly 73 from inadvertently falling out of bowl 47 or from backing out when the power unit is separated from bowl unit 23. Furthermore, when the power unit 23 and bowl unit 25 are assembled together, as shown in FIG. 2, the venturi 41 engages the ring 75 and presses it into snug wedging engagement with the bowl 47. As shown, the venturi has a radial shoulder 85 which engages a radial shoulder 87 on the ring 75. However, after the power unit 23 is separated from the bowl unit 25, the filter bag assembly 73 can be manually withdrawn from the bowl 47 simply by reaching into the bowl and grasping the ring 75. Since the grasped portion of the ring 75 is downstream of the dirt within bowl 47, the user's hands are not dirtied in this action.

After removal of the dust bag assembly 73 from the bowl 47, the dirt is emptied simply by turning the bowl 47 upside down. Thereafter, the dust bag assembly 73 can be shaken or washed, and reinserted in the bowl 47. The power unit 23 and bowl unit 25 are then reassembled as described and the vacuum cleaner is again ready for use. By providing that the filter bag assembly 73 remains in position in the bowl 47 when the power and bowl units 23, 25 are detached and separated, all of the dirt remains securely trapped in the dirt collecting chamber 80 in bowl 47 and cannot spill out until the filter bag assembly 73 is thereafter removed.

It will be apparent to those skilled in the art that various additions, substitutions, modifications, and omissions can be made to the present invention without departing from the scope or spirit of the invention. Thus, it is intended that the present invention covers such provided that they come within the scope of the appended claims and their equivalents.

What is claimed is:

1. A hand-held electric vacuum cleaner comprising first and second separable units interconnected by releasable latch means, said first unit including a housing enclosing a motor and fan and having switch means for operating said motor, venturi means carried by said housing and extending forwardly of said fan, said venturi means having an opening therethrough communicated with and narrowing toward said fan and operable to increase the velocity of inlet air entering said fan, said second unit including a hollow bowl having an open end receiving said venturi means, a ring removably fitted in said bowl and carrying a filter bag, means limiting the inward movement of said ring relative to said bowl, said venturi means engaging said ring and pressing it in place within said bowl, said releasable latch means including cooperable means on said venturi means and bowl and manually releasable to permit separation of said first and second units, said ring and filter bag being removable from said bowl upon separation of said first and second units.

2. The improvement as claimed in claim 1, said ring and filter bag being permanently fixed together.

3. The vacuum cleaner as claimed in claim 1, said releasable latch means including a flexible member carried by said venturi means and engageable in an opening in said bowl.

4. The vacuum cleaner as claimed in claim 1, said bowl having an internal tapered portion, said ring being adapted to wedge into engagement with said tapered portion and having a feathered edge adapted to cold flow into sealing engagement with said tapered portion.

* * * * *